US009745095B2

(12) United States Patent
Hermel

(10) Patent No.: US 9,745,095 B2
(45) Date of Patent: Aug. 29, 2017

(54) CONTAINER HAVING A MINI-PETAL-SHAPED BOTTOM WITH TRANSVERSE GROOVES

(71) Applicant: SIDEL PARTICIPATIONS, Octeville-sur-Mer (FR)

(72) Inventor: Wilfried Hermel, Octeville-sur-Mer (FR)

(73) Assignee: SIDEL PARTICIPATIONS, Octeville-sur-Mer (FR)

( * ) Notice: Subject to any disclaimer, the term of this patent is extended or adjusted under 35 U.S.C. 154(b) by 0 days.

(21) Appl. No.: 15/016,925

(22) Filed: Feb. 5, 2016

(65) Prior Publication Data

US 2016/0244197 A1 Aug. 25, 2016

(30) Foreign Application Priority Data

Feb. 23, 2015 (FR) ..... 15 51510

(51) Int. Cl.
*B65D 1/02* (2006.01)

(52) U.S. Cl.
CPC .... *B65D 1/0284* (2013.01); *B65D 2501/0036* (2013.01)

(58) Field of Classification Search
CPC .. B65D 1/0284; B65D 1/0261; B65D 1/0223; B65D 11/24; B65D 11/22; B65D 11/20; B65D 21/0235; B65D 21/0215; B65D 21/0209; B65D 21/02
USPC ..... 215/375, 374, 373, 372, 377, 376; 220/608, 604, 623, 610; D9/520, 548, D9/516; 206/507, 511, 509, 505, 504
See application file for complete search history.

(56) References Cited

U.S. PATENT DOCUMENTS

2009/0308835 A1* 12/2009 Boukobza ..... B65D 1/0284 215/370
2013/0264305 A1 10/2013 Boukobza
2014/0103007 A1 4/2014 Boukobza et al.

FOREIGN PATENT DOCUMENTS

FR 2 974 069 A1 10/2012
JP H06-156464 A 6/1994
WO 2012/069759 A1 5/2012
WO 2014/207331 A1 12/2014

OTHER PUBLICATIONS

French Search Report issued in Application No. 1551510, dated Oct. 22, 2015.

* cited by examiner

*Primary Examiner* — Robert J Hicks
(74) *Attorney, Agent, or Firm* — Young & Thompson

(57) ABSTRACT

Container made of plastic material includes a body and a petal-shaped bottom (3) extending the body, the bottom (3) having a bottom wall (4) of general convex shape toward the outside of the container, from which feet (7) formed by protrusions project, separated two by two by portions of the bottom wall (4) forming recessed valleys (12) that extend radially to a periphery (8) of the bottom (3), the bottom (3) also including, in each valley (12), in the vicinity of the periphery (8) of the bottom (3), at least one groove (17, 18) that extends transversely relative to the radial direction of extension of the valley (12).

12 Claims, 3 Drawing Sheets

D1
D2
D3
H1
H2
H3
H4
A1
A2
R1
R2
R3
R4
X

CONTAINER HAVING A MINI-PETAL-SHAPED BOTTOM WITH TRANSVERSE GROOVES

FIELD OF THE INVENTION

The invention relates to the field of containers, particularly bottles or jars, manufactured by blow molding or stretch-blow molding from parisons (preforms or intermediate containers) made of plastic material such as polyethylene terephthalate (PET).

BACKGROUND OF THE INVENTION

A container generally comprises an open neck, through which the contents (ordinarily a liquid) are introduced and through which the contents are emptied, a body, which imparts to the container its volume, and a bottom, which closes the body opposite the neck and forms a base intended to ensure the stability and the holding of the container when it rests on a support such as a table.

Containers are known that are provided with petal-shaped bottoms, which comprise projecting feet, in the shape of petals, separated by convex wall portions, called hollows or valleys, which extend radially from a central zone of the bottom. The feet are intended to ensure the stable holding of the container on a support; the valleys are intended to absorb the forces (thermal and/or mechanical) exerted by the contents.

The large-height petal-shaped bottoms (i.e., whose feet have a height in a ratio with the diameter of the container that is greater than or equal to ½) exhibit a high mechanical strength; this makes them particularly suitable for carbonated liquids (in other words, for carbonated beverages) that generate pressures of more than 2.5 bars. An illustrative example of this type of bottom will be found in the international application WO 2012/069759 (SIDEL).

However, the petal-shaped bottoms of this type consume a considerable amount of material (a 0.5 l container with a standard petal-shaped bottom has a weight on the order of—or greater than—approximately 18 g).

An attempt has been made to adapt the petal-shaped bottoms to flat liquids (for example, plain water) or slightly carbonated liquids (generating an internal pressure that is less than or equal to 2.5 bars), or else to slightly pressurized liquids (on the order of 0.3 bar to 1 bar) by means of a neutral gas (such as nitrogen). To limit the amount of material necessary for the manufacturing of a petal-shaped bottom, the height of the bottom has been reduced, and the bottom has been reinforced, in the valleys, by means of grooves overlapping a central dome. This technique, illustrated in the international application WO 2014/207331 (SIDEL), proved itself and made it possible to reduce the quantity of material to approximately 10 g for a container with a 0.5 l capacity. However, constraints with regard to conserving material are steadily tightening, and today manufacturers are being asked to reduce the weight of the containers by an additional 10 to 20% (or weight on the order of 8 g to 9 g for a container with a 0.5 l capacity).

Under these conditions, the known shapes cease to be pertinent and new solutions should be found to maintain or to increase, at reduced weight, the rigidity of the bottoms of the containers.

In particular, it was noted that by lightening by 15% the petal-shaped bottom of the type described in the above-cited application WO 2014/207331, this bottom deforms under an internal pressure that is greater than or equal to 0.5 bar. More specifically, folds appear in an uncontrolled manner in the valleys, which weakens the bottom of the container and makes its stacking (and therefore its palletization) hazardous.

SUMMARY OF THE INVENTION

One objective is consequently to propose a container whose bottom has good mechanical strength in spite of a reduced quantity of material and that can in particular withstand a stacking to be able to be palletized without risk.

For this purpose, there is proposed a container made of plastic material that comprises a body and a petal-shaped bottom having a periphery by which it connects to the body, with the bottom comprising a bottom wall of a general convex shape toward the outside of the container, from which project feet that are formed by protrusions, separated two by two by portions of the bottom wall forming recessed valleys that extend radially up to the periphery of the bottom, with the bottom also comprising, in each valley, in the vicinity of the periphery of the bottom, at least one groove that extends transversely relative to the radial direction of extension of the valley.

These grooves make it possible to control, by absorbing them, the deformations that are due to the pressure prevailing in the container, which prevents in particular the unexpected formation of folds in the valleys, and imparts to the bottom good mechanical strength that makes it possible for the container to be stacked (and therefore palletized).

Various additional characteristics can be provided, by themselves or in combination:

- Each groove extends from one side of the valley to the other;
- Each groove has a central hollow that, in radial cross-section, has the shape of an arc with concavity rotated toward the outside of the container and fillets that border the central hollow and have, in radial cross-section, the shape of an arc with concavity rotated toward the inside of the container;
- The groove has a depth of between 0.8 mm and 1.5 mm;
- The bottom comprises at least two adjacent grooves, namely a main groove and at least a secondary groove offset from the main groove toward the center of the bottom;
- The secondary groove has a length, measured transversely, that is less than that of the main groove;
- With the bottom having an overall diameter D1, the feet define a standing plane that has a diameter D2 such that:

$$0.67 \cdot D1 \leq D2 \leq 0.72 \cdot D1$$

- The bottom has a total height H1 such that:

$$0.25 \cdot D1 \leq H1 \leq 0.28 \cdot D1$$

- The bottom has a concentric central region and a concentric peripheral region that are separated by a continuous setback that overlaps the feet and the valleys;
- Each foot is provided with a groove that extends axially and overlaps an apex of the foot.

BRIEF DESCRIPTION OF THE DRAWINGS

Other objects and advantages of the invention will be brought out in the description of an embodiment, given below with reference to the accompanying drawings in which.

DETAILED DESCRIPTION OF THE INVENTION

Figure 1:
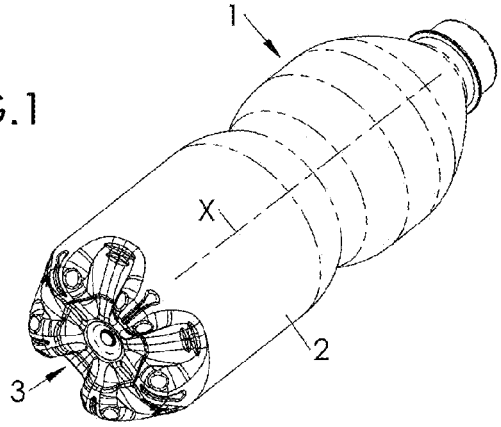
FIG. 1 is a bottom perspective view of a container having a petal-shaped bottom.

Shown in a bottom perspective in FIG. 1 is a container 1—in this case a bottle—that is obtained by blow molding or stretch-blow molding from a preform made of thermoplastic material, for example of polyethylene terephthalate (PET), previously heated.

The container 1 extends along a main axis X and comprises a side wall called body 2, and a bottom 3 that extends and closes the body 2 at a lower end of the latter.

The bottom 3 is petal-shaped and comprises a bottom wall 4 with a general convex shape toward the outside of the container 1 (i.e., downward when the container 1 is set flat). This wall 4 extends from a central dome 5 with concavity rotated toward the outside of the container 1. In the center of the dome 5, a button 6 coming from injection extends in axial projection, the material of which has remained approximately amorphous during the forming of the container 1. The dome 5 in particular has the function of stretching the material at the center of the bottom 3, so as to increase its crystallinity and therefore its mechanical strength.

The bottom 3 furthermore comprises a series of feet 7 formed by protrusions in axial projection from the bottom wall 4 toward the outside of the container 1. The feet 7 extend radially from the central dome 5 to a periphery 8 of the bottom 3 where it is connected to the body 2. The overall radial extension of the bottom 3, measured perpendicularly to the axis X in the area of its periphery 8 (FIG. 5), is denoted as D1. In the case of a container 1 with a cylindrical body 2 (as in the example illustrated), the radial extension D1 is its diameter.

Figure 3:
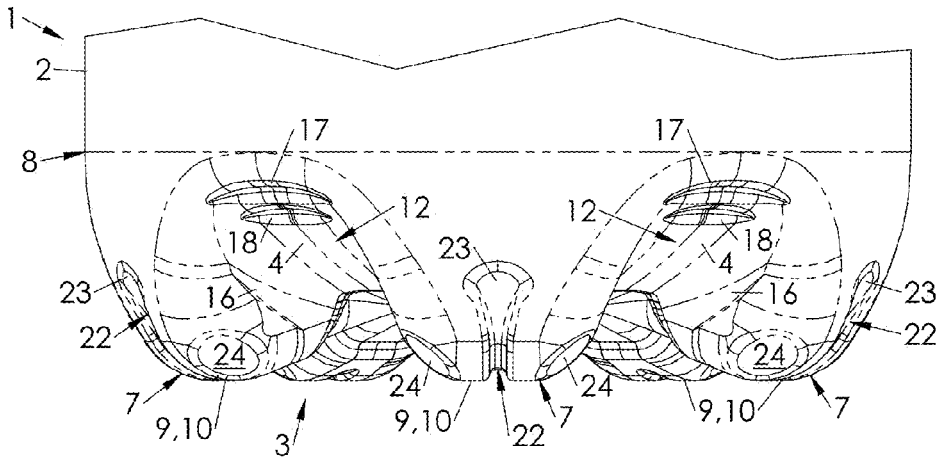
FIG. 3 is a detail view, from the side, of the bottom of FIG. 2.

The parts that project the most or apexes 9 of the feet 7 together form a standing plane 10 by which the container 1 can rest on a flat surface (for example a table). As can be seen in FIG. 3, the standing plane 10 is situated radially set back relative to the periphery 8. The radial extension (i.e., the diameter in the example illustrated) of the standing plane 10 is denoted as D2, and the total height of the bottom 3 (which corresponds to that of the feet 7), measured axially from the standing plane 10 to the periphery 8 of the bottom 3, is denoted as H1.

The total height H1 of the bottom is advantageously between 25% and 28% of the overall radial extension D1 of the bottom 3:

$$0.25 \cdot D1 \leq H1 \leq 0.28 \cdot D1$$

A standard petal-shaped bottom would have a ratio H1/D1 of approximately 0.5. This bottom 3, which can be referred to as "mini-petal-shaped" because of its small height ratio H1/D1, makes it possible to limit the amount of material necessary for the formation of the bottom 3 while making it possible, thanks to its petal-shaped structure, to accommodate pressurized contents.

Among this type of contents are cited the flat liquids that are associated with the addition, immediately after filling and before capping, of a drop of liquid nitrogen whose vaporization puts the contents of the container under excess pressure, or else the slightly carbonated beverages (such as certain mildly sparkling waters). The relative pressure (i.e., the portion of the absolute pressure that is greater than the atmospheric pressure) in the container 1 is, according to the type of contents, between 0.3 bar and 2.5 bars.

Furthermore, the radial extension D2 of the standing plane 10 is preferably between 67% and 72% of the overall radial extension D1 of the bottom 3:

$$0.67 \cdot D1 \leq D2 \leq 0.72 \cdot D1$$

This dimensional ratio offers a good compromise between the stability of the bottom 3 (which increases based on the ratio D2/D1) and its blowability (i.e., its capacity to be correctly formed by blow molding), which, in contrast, decreases based on the ratio D2/D1.

Figure 2:
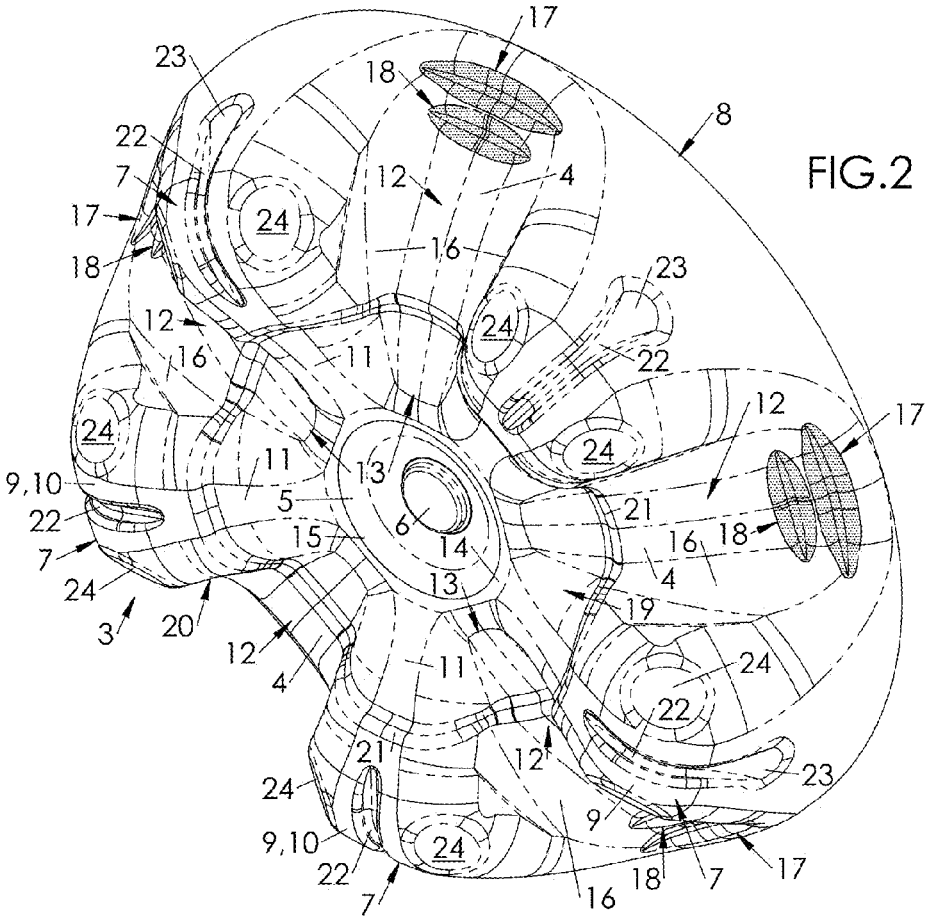
FIG. 2 is a detail view, on an enlarged scale, of the bottom of the container of FIG. 1.
Figure 4:
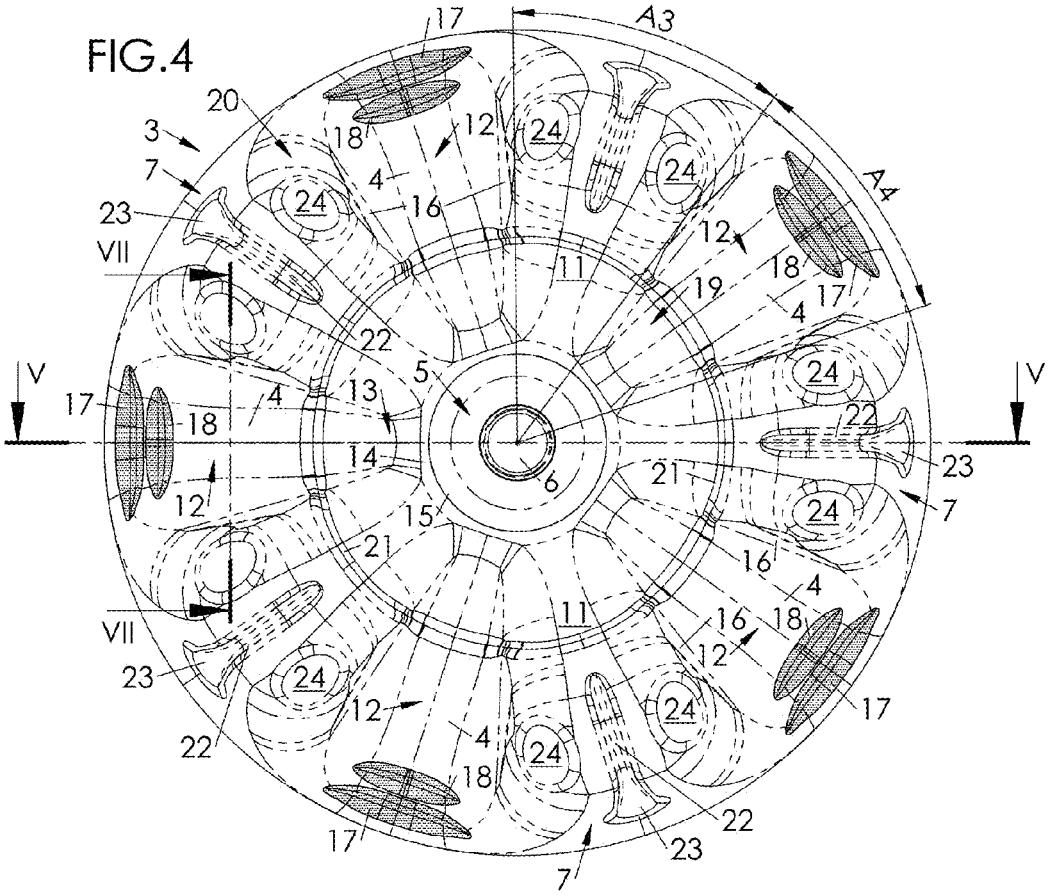
FIG. 4 is a bottom view, on an enlarged scale, of the bottom of FIGS. 2 and 3.

As is readily seen in FIGS. 2 to 4, the feet 7 become thinner from the inside to the outside of the container 1 (i.e., from top to bottom) and expanding from the central dome 5 to the periphery 8.

Figures 5, 6, 7:
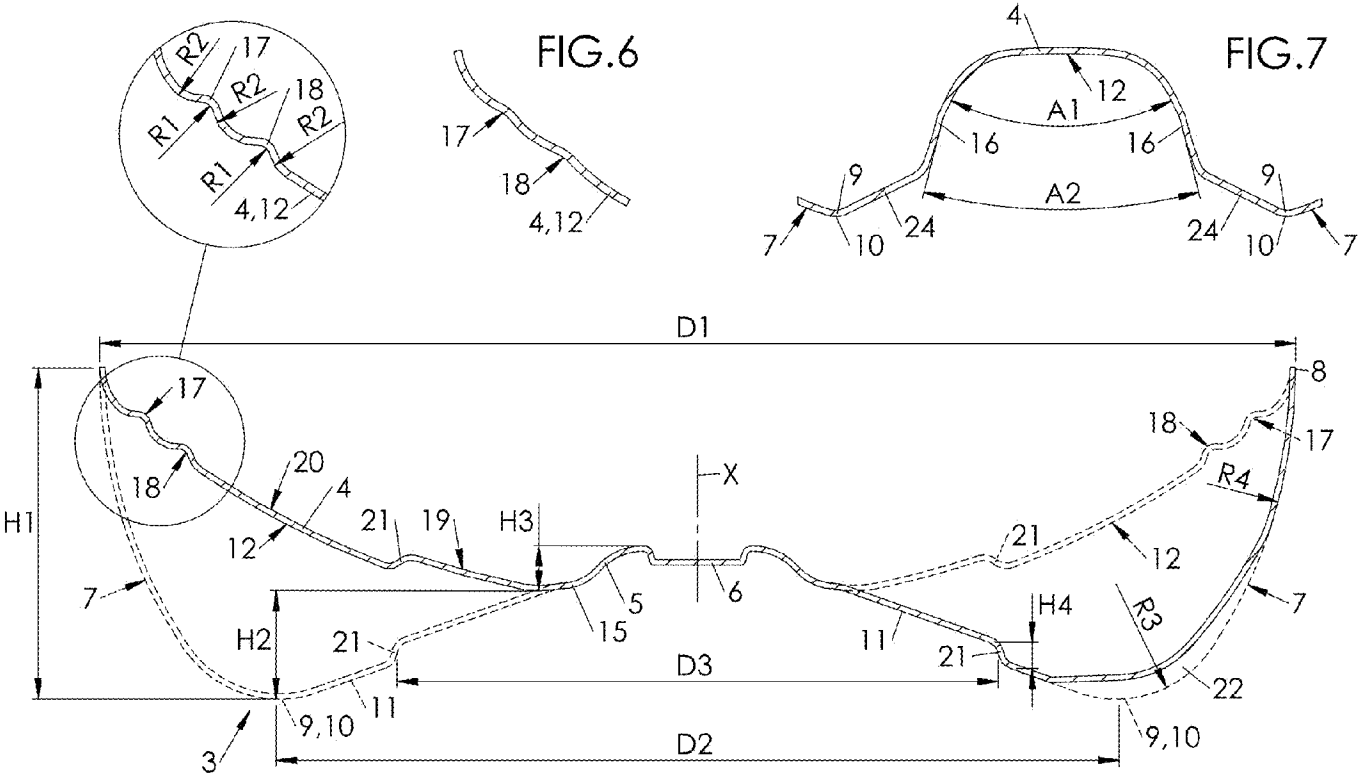
FIG. 5 is a cross-section of the bottom of FIG. 4, along the cutting plane V-V, with a detail on an enlarged scale in an inset.
FIG. 6 is a detail view in an inset of FIG. 5, in which the material is deformed under the action of the pressure prevailing in the filled container.
FIG. 7 is a detail cutaway view of the bottom of FIG. 4, along the cutting plane VII-VII.

Each foot 7 has an end face 11 that extends in a gentle slope from the dome 5 to the apex 9 and that, as can be seen in FIGS. 2 and 5, has a width that will slightly increase from the vicinity of the dome 5 to the periphery 8.

The axial extension of the end face 11 (also called arrow or bottom guard), measured between the standing plane 10 and the edge of the dome 5, is denoted as H2. The arrow H2 is less than the height H1 of the bottom 3, but without being insignificant relative to it. More specifically, the arrow H2 is between 28% and 32% of the height H1 of the bottom 3:

$$0.28 \cdot H1 \leq H2 \leq 0.32 \cdot H1.$$

The relatively small ratio H2/H1 again offers a good compromise between the mechanical strength of the bottom (which increases based on the ratio H2/H1) and its blowability (which, in contrast, decreases with the ratio H2/H1).

According to a preferred embodiment, illustrated in the figures, the arrow H2 is approximately 31% of the height H1 of the bottom 3:

$$H2 \approx 0.31 \cdot H1$$

Furthermore, the depth, measured axially, of the dome 5 is denoted as H3. This depth H3 is preferably between 2 mm and 3 mm:

$$2\ \text{mm} \leq H3 \leq 3\ \text{mm}$$

For a container with a 0.5 l capacity, having an overall diameter D1 on the order of 65 mm, the depth H3 of the dome is relatively significant and makes it possible to stretch the material to the center of the bottom 3, which increases its structural rigidity and therefore its mechanical strength.

As is readily seen in FIGS. 2, 3, and 4, the feet 7 are separated two by two by portions 12 of the bottom wall 4 called valleys, which extend radially in a star-shaped manner from the dome 5 to the periphery 8.

The valleys 12 extend recessed between the feet 7 that they separate two by two. The valleys 12 have, in cross-section (i.e., along a plane perpendicular to the radial direction, see FIG. 7), a U-shaped profile that can flare out from the inside to the outside of the container (i.e., downward).

According to a particular embodiment illustrated in FIGS. 2 and 4, the valleys 12 are not connected directly to the dome 5 but rather end on the inside, at an inner end 13, at a distance from the dome 5, with an intermediate space 14 thus being defined between the end 13 and an outer edge 15 of the dome 5.

As can be seen in FIGS. 2 and 4, the feet 7 are equal in number to the valleys 12. In the example illustrated, the bottom 3 comprises five feet 7 and five valleys 12, regularly alternating and distributed in a star shape. This number constitutes a good compromise; it could, however, be lower (but greater than or equal to three), or higher (but preferably less than or equal to nine).

Each foot 7 has two sides 16 that each laterally border a valley 12. As is evident in FIG. 2, and as can be seen in FIG. 7, the sides 16 are not vertical (because the bottom 3 would then be difficult, indeed impossible, to blow mold), but inclined while opening from the valley 12 toward the outside. The angular opening between the sides 16 is not necessarily constant along the distance to the valley 12. Thus, according to an embodiment illustrated in FIG. 7, each side 16 has, essentially at mid-height of the foot, a break in the slope, such that between the sides 16 that face one another:

A first angular opening A1 is defined in the vicinity of the valley 12,

A second angular opening A2 is defined in the vicinity of the apex 9, preferably less than or equal to the first angular opening A1:

$$A2 \leq A1$$

The first angular opening A1 is advantageously between 45° and 55°:

$$45° \leq A1 \leq 55°$$

According to a preferred embodiment, the first angular opening A1 is approximately 50°:

$$A1 \cong 50°$$

Furthermore, the second angular opening A2 is advantageously between 15° and 21°:

$$15° \leq A1 \leq 21°$$

According to a preferred embodiment, the second angular opening A2 is approximately 18°:

$$A2 \cong 18°$$

The first angular opening A1, rather large, improves the blowability of the bottom 3. The second angular opening A2, smaller, increases the stability of the bottom 3 by imparting a certain verticality to the feet 7, from the side of the apex 9 thereof.

The pressurization of the container 1 is likely to deform the bottom 3. So as to limit these deformations, the bottom 3 is provided, in each valley 12, in the vicinity of the periphery 8 (i.e., in the vicinity of the junction between the valley 12 and the body 2), with at least one groove 17 that extends transversely relative to the radial direction of extension of the valley 12.

In the valley 12, this groove 17 forms a hollow toward the inside of the container 1. The groove 17 has a shape that is tapered like a grain of rice and is wider (measured radially) in the center of the valley 12 than on the edges of the latter. For better visibility, in FIGS. 2 and 4, the grooves 17 have been shaded with a dot pattern.

As can be seen in FIGS. 2 and 4, each groove 17 can have a length (when measured transversely) that is greater than the width of the valley 12 and consequently encroaches, at its lateral ends, on the sides 16 of the feet 7 that border the valley 12.

The groove 17 forms a wave in the valley 12 and comprises:

A central hollow that, in radial cross-section, has the shape of an arc with concavity rotated toward the outside of the container 1 and whose radius is denoted R1, and Fillets that border the central hollow and also, in radial cross-section, have the shape of an arc with concavity rotated toward the inside of the container 1 and whose radius is denoted R2.

The depth of the groove 17 is relatively small, being between 0.8 mm and 1.5 mm. According to a particular embodiment, the depth of the groove 17 is approximately 1 mm.

According to an embodiment illustrated in the figures, the bottom 3 comprises at least two adjacent grooves in each valley 12, namely a first so-called main groove 17, and a second so-called secondary groove 18, contiguous to the main groove 17. The secondary groove 18 is offset from the main groove 17 toward the center of the bottom 3 and also extends transversely from one edge of the valley 12 to the other, by being, however, less long (measured transversely) than the main groove 17. Thus, as can be seen in the example of FIGS. 2 and 4, the secondary groove 18 only slightly encroaches, at its lateral ends, on the sides 16 of the feet 7.

Like the main groove 17, the secondary groove 18 has a shape that is tapered like a grain of rice by being wider (measured radially) in the center of the valley 12 than on the edges of the latter. In FIGS. 2 and 4, the secondary grooves 18 have also been shaded by a dot pattern.

Likewise, the secondary groove 18 forms a wave in the valley 12 and comprises:

A central hollow that, in radial cross-section, has the shape of an arc with concavity rotated toward the outside of the container 1 and with the same radius R1 as the main groove 17, and Fillets that border the central hollow and also, in radial cross-section, have the shape of an arc with concavity rotated toward the inside of the container 1 and with the same radius R2 as that of the fillets of the main groove 17.

The radius R1 of the central hollow of each groove 17, 18 is between 0.3 mm and 1 mm. According to a particular embodiment, the radius R1 is approximately 0.5 mm.

The radius R2 of the fillets of each groove 17, 18 is greater than the radius R1 of the central hollow. This radius R2 is between 1.2 mm and 1.8 mm. According to a particular embodiment, the radius R2 is approximately 1.5 mm.

Like the main groove 17, the secondary groove 18 has a relatively small depth, between 0.8 mm and 1.5 mm. According to a particular embodiment, the depth of the secondary groove 18 is approximately 1 mm.

When the container 1 is pressurized, the deformations due to the stresses to which the bottom is subjected are located on the main grooves 17 (and the secondary grooves 18 when they exist), which deform by becoming flat, as illustrated in FIG. 6, which prevents any constriction of the valley 12, in particular at its junction with the body 2 of the container 1. The result is a better mechanical stability of the bottom 3, which provides a better rigidity for the container 1 and makes possible its stacking (and therefore its palletization) without the risk of collapsing.

The presence of secondary grooves 18 makes it possible to increase the capacity of the bottom 3 to absorb more significant deformations, in particular when the pressure in the container is relatively high (between 1 bar and 2.5 bars).

The number of secondary grooves 18 present in each valley 12 can be greater than one, i.e., there may exist a total number of grooves 17, 18 (main and secondary) that is at least equal to two in each valley 12, all depending on the deformation that the container 1 is assumed to withstand (and therefore the pressure in the latter).

According to a preferred embodiment, the bottom 3 has two concentric regions, namely an annular central region 19 that surrounds the dome 5, and an annular peripheral region 20 that surrounds the central region 19, separated by a setback 21 that extends axially over a predetermined height H4 (measured axially). The setback 21 is midway relative to the bottom 3; i.e., it has a diameter, denoted D3, of between 45% and 55% of the overall diameter D1 of the bottom 3:

$$0.45 \cdot D1 \leq D3 \leq 0.55 \cdot D1$$

And, preferably, the diameter D3 of the setback 21 is equal to approximately half of the overall diameter D1 of the bottom 3:

$$D3 \cong 0.5 \cdot D1$$

The setback 21 extends in a continuous manner around the dome 5 and overlaps both the feet 7 (including the sides 16) and the valleys 12.

Because of the presence of the axial setback 21, the central region 19 is slightly raised relative to the peripheral region 20, by being offset toward the inside of the container 1.

The height H4 of the setback 21 is essentially constant over its contour by advantageously being between 0.5 mm and 1.5 mm. For a container with a 0.5 liter capacity (which corresponds to the example illustrated), the height H4 of the setback is approximately 1 mm.

The setback 21 has as its function to maintain the stability of the container 1 under relatively high pressure conditions (of between 1 bar and 2.5 bars) by opposing the return of the bottom 3 and by contributing, under the internal pressure of the container, to expanding the standing plane 10, which increases the stability of the container 1.

The angular opening, measured around the axis X of the container 1 in a plane perpendicular to the axis X, of the top part of the feet 9, i.e., without counting the sides 16, is denoted as A3, and the angular opening that is defined between the top parts of the two consecutive feet 7, i.e., the portion of the bottom 3 including a valley 12 and the sides 16 that border it (cf. FIG. 4), is denoted as A4. According to a preferred embodiment, the angular openings A3, A4 are essentially identical (variations of several degrees may exist):

$$A3 \cong A4$$

The result, in combination with the values, indicated above, of the angular openings A1, A2 defined transversely between the sides 16, is a good compromise between the mechanical performances of the bottom 3 (i.e., the capacity of the latter to withstand deformations, and, when the latter take place, in undergoing them in a controlled manner) and its blowability (i.e., the capacity of the bottom 3 to be correctly formed by blow molding).

The value of the angular openings A3, A4 consequently depends on the number of feet 7 (or the number of valleys 12, equal to the number of feet). More specifically, if the number of feet is denoted as N, then the openings A3 and A4, measured in degrees, are calculated as follows:

$$A3 \cong A4 \cong \frac{360°}{2N}$$

Thus, when the bottom comprises five feet 7, as in the illustrated case, the angular openings A3, A4 are approximately 36°.

Furthermore, as can be readily seen in FIGS. 3 and 5, the apexes 9 of the feet are rounded, and have, in a radial plane, a radius R3 that is between 8% and 12% of the overall diameter D1 of the bottom 3:

$$0.08 \cdot D1 \leq R3 \leq 0.12 \cdot D1$$

According to a preferred embodiment, the radius R3 of the apexes 9 of the feet 7 is approximately equal to one-tenth of the overall diameter D1 of the bottom 3:

$$R3 \cong 0.1 \cdot D1$$

This sizing makes it possible to ensure good blowability of the bottom 3 while imparting good stability to it.

Each foot 7 can be connected to the body 2 by a flat face. However, according to a preferred embodiment that is illustrated in FIG. 5, each foot 7 is connected to the body 2 by a curved face, having a radius R4 of between ⅓ and half of the overall diameter D1 of the bottom 3:

$$\frac{D1}{3} \leq R4 \leq \frac{D1}{2}$$

According to a preferred embodiment, the radius R4 of the connecting faces of the feet 7 to the body 2 is on the order of 40% of the overall diameter D1 of the bottom 3:

$$R4 \cong 0.4 \cdot D1$$

This dimensional ratio contributes to the good blowability of the bottom 3, without impairing its stability.

In addition, according to an advantageous embodiment illustrated in the drawings, each foot 7 is provided with a recessed groove 22, which extends radially by overlapping the apex 9 (and therefore the standing plane 10).

The grooves 22 have as their function to stiffen the bottom 3. Under the action of mechanical stresses exerted on the container 1 (in particular under the action of the pressure prevailing in the latter), the grooves 22 have a tendency to flow by expanding and flattening, which brings about an enlarging of the feet 7 at their apexes 9 and imparts to the sides 16 a certain verticality that opposes the overall settling of the bottom 3.

As can be seen in FIGS. 2, 3 and 4, each groove 22 has, beside its junction with the body 2, an enlarged terminal zone 23 that promotes the blowability and limits the risk of folds appearing during the pressurization.

Finally, as can be seen in FIGS. 2, 3, 4 and 7, each foot 7 comprises facets 24 that are contiguous laterally (i.e., transversely relative to a radial direction) to the apexes 9 of each foot.

According to an embodiment that is illustrated in the figures, each foot 7 is provided with a pair of facets 24. These facets 24, with an essentially circular or oval contour, make it possible to save on the amount of material required for forming the bottom 3 while at the same time stiffening the feet 7 and therefore the bottom 3.

The invention claimed is:

1. A container (1) made of plastic material, comprising: a body (2); and a petal-shaped bottom (3) having a periphery (8) by which the bottom (3) connects to the body (2), the bottom (3) comprising a bottom wall (4) of convex shape toward the outside of the container (1), from which feet (7) formed by protrusions project, separated two by two by portions of the bottom wall (4) forming recessed valleys (12) that extend radially to the periphery (8) of the bottom (3), wherein the bottom (3) also comprises, in each valley (12), in the vicinity of the periphery (8) of the bottom (3), at least one groove (17, 18) that extends transversely relative to the radial direction of extension of the valley (12).

2. The container (1) according to claim 1, wherein the groove (17, 18) extends from one edge of the valley (12) to the other.

3. The container (1) according to claim 2, wherein the groove (17, 18) has a central hollow that, in radial cross-section, has the shape of an arc with concavity rotated toward the outside of the container and fillets that border the central hollow and have, in radial cross-section, the shape of an arc with concavity rotated toward the inside of the container.

4. The container (1) according to claim 1, wherein the groove (17, 18) has a central hollow that, in radial cross-section, has the shape of an arc with concavity rotated toward the outside of the container and fillets that border the central hollow and have, in radial cross-section, the shape of an arc with concavity rotated toward the inside of the container.

5. The container (1) according to claim 1, wherein the groove (17, 18) has a depth of between 0.8 mm and 1.5 mm.

6. The container (1) according to claim 1, wherein the at least one groove (17, 18) of the bottom (3) comprises a main groove (17) and at least a secondary groove (18) offset from the main groove (17) toward the center of the bottom (3).

7. The container (1) according to claim 6, wherein the secondary groove (18) has a length, measured transversely, that is less than that of the main groove (17).

8. The container (1) according to claim 1, wherein with the bottom (3) having an overall diameter D1, the feet (7) define a standing plane (10) that has a diameter D2 such that:

$$0.67 \cdot D1 \leq D2 \leq 0.72 \cdot D1.$$

9. The container (1) according to claim 1, wherein the bottom (3) has an overall diameter D1 and a total height H1 such that:

$$0.25 \cdot D1 \leq H1 \leq 0.28 \cdot D1.$$

10. The container (1) according to claim 1, wherein the bottom (3) has a concentric central region (19) and a concentric peripheral region (20) that are separated by a continuous setback (21) that overlaps the feet (7) and the valleys (12).

11. The container (1) according to claim 1, wherein each foot (7) is provided with a groove (22) that extends axially and overlaps an apex (9) of the foot (7).

12. The container (1) according to claim 1, wherein the at least one groove (17, 18) of the bottom (3) comprises at least two adjacent grooves (17, 18).

* * * * *